US007674156B2

(12) United States Patent
Son et al.

(10) Patent No.: US 7,674,156 B2
(45) Date of Patent: Mar. 9, 2010

(54) CLEANING DEVICE FOR CHEMICAL MECHANICAL POLISHING EQUIPMENT

(75) Inventors: Jun Ho Son, Ansan-si (KR); Sung Bum Seo, Osan-si (KR)

(73) Assignee: K.C. Tech Co., Ltd, Kyonggi (KR)

( * ) Notice: Subject to any disclaimer, the term of this patent is extended or adjusted under 35 U.S.C. 154(b) by 371 days.

(21) Appl. No.: 11/868,930

(22) Filed: Oct. 8, 2007

(65) Prior Publication Data

US 2009/0093199 A1 Apr. 9, 2009

(51) Int. Cl.
*B24B 53/00* (2006.01)

(52) U.S. Cl. ..... 451/56; 451/72; 451/444; 134/104.1

(58) Field of Classification Search ..... 451/56, 451/72, 444; 134/104.1
See application file for complete search history.

(56) References Cited

U.S. PATENT DOCUMENTS

| | | | | |
|---|---|---|---|---|
| 4,269,264 | A * | 5/1981 | Goeldner | 165/95 |
| 4,750,547 | A * | 6/1988 | Sakamoto | 165/84 |
| 5,611,943 | A * | 3/1997 | Cadien et al. | 216/88 |
| 5,945,346 | A * | 8/1999 | Vanell et al. | 438/691 |
| 6,022,265 | A * | 2/2000 | Drill et al. | 451/56 |
| 6,139,404 | A * | 10/2000 | Yau | 451/56 |
| 6,165,053 | A * | 12/2000 | Yokokawa et al. | 451/53 |
| 6,283,840 | B1 | 9/2001 | Huey | |
| 6,350,183 | B2 * | 2/2002 | Manfredi | 451/56 |
| 6,443,816 | B2 * | 9/2002 | Inoue et al. | 451/56 |
| 6,500,054 | B1 * | 12/2002 | Ma et al. | 451/56 |
| 6,508,697 | B1 * | 1/2003 | Benner et al. | 451/443 |
| 6,517,416 | B1 * | 2/2003 | Crevasse et al. | 451/41 |
| 6,533,645 | B2 * | 3/2003 | Tolles | 451/41 |
| 7,452,264 | B2 * | 11/2008 | Mavliev et al. | 451/56 |
| 7,455,575 | B2 * | 11/2008 | Kim et al. | 451/444 |

(Continued)

FOREIGN PATENT DOCUMENTS

EP 1 118 432 A2 7/2001

(Continued)

OTHER PUBLICATIONS

WIPO WO 99/11433 Mar. 1999.*

*Primary Examiner*—Frankie L Stinson
(74) *Attorney, Agent, or Firm*—Steven J. Hultquist; Intellectual Property, Technology Law

(57) ABSTRACT

A cleaning device for chemical-mechanical equipment, which includes: an irrotatable center shaft irrotatably coupled with a spindle which is rotated, the irrotatable center shaft including a first channel and a second channel formed in an interior of the irrotatable center shaft, cleaning liquid flowing into the first channel and compressed gas flowing into the second channel; and a nozzle block coupled with the spindle so as to revolve about the irrotatable center shaft above a polishing pad, the nozzle block mixing cleaning liquid supplied through the first channel with compressed gas supplied through the second channel so as to generate twin-fluid, and pressure-injecting the mixed twin-fluid on the polishing pad. Accordingly, cleaning liquid is pressurized so as to be rapidly injected on a polishing pad so that slurry particles and alien substances on the polishing pad are completely removed. Furthermore, wafer scratch can be prevented and the life of the polishing pad can also be increased.

15 Claims, 4 Drawing Sheets

U.S. PATENT DOCUMENTS

2001/0041517 A1 11/2001 Manfredi
2004/0162007 A1 * 8/2004 Phan et al. ..... 451/36

FOREIGN PATENT DOCUMENTS

JP 10-244459 * 9/1998
JP 11-285967 * 10/1999
JP 2006-218553 * 8/2003
KR 10-0490266 B1 5/2005

* cited by examiner

RELATED ART

CLEANING DEVICE FOR CHEMICAL MECHANICAL POLISHING EQUIPMENT

TECHNICAL FIELD

The present invention relates to a cleaning device for a chemical-mechanical polishing equipment, and more particularly to a cleaning device for a chemical-mechanical polishing equipment which removes alien substances including slurry particles generated in a polishing pad of the polishing equipment performing chemical-mechanical polishing operation, so that wafer scratch can be prevented.

BACKGROUND ART

Generally, a semiconductor element is manufactured by performing various manufacturing processes, such as a deposition process, a photograph process, and an etching process, and an ion implantation process, to a silicon wafer.

For example, a silicon wafer has various process layers during a manufacturing process, and a process of selectively removing and patterning some of such process layers, and then depositing an additional process layer on a surface of a preformed process layer, can be repeatedly performed.

Such a process layer may be an insulation layer, a gate oxide layer, a conduction layer, and a metal or glass layer, etc.

Herein, in a specific process, an uppermost surface of a process layer preformed on a wafer is preferably flat so as to allow a succeeding process layer to be deposited thereon.

Therefore, a silicon wafer passes through a polishing process for polishing a preformed process layer to be flat, so that a succeeding process can safely be performed thereon.

Particularly, a wafer polishing process is a process for flattening a surface of a wafer. For an representative example, a chemical-mechanical polishing/planarization (CMP) process has been suggested, in which a chemical slurry is applied on a polishing pad to make friction contact with a surface of a wafer, and in a state of a surface of the wafer being pressurized on the polishing pad, the wafer and the polishing pad perform relative friction movement each other so as to safely flatten a surface of the wafer.

Meanwhile, an equipment for performing a CMP process, as described above, is disclosed in Korean Patent No. 490266 filed in the name of the present applicant.

FIG. 1 is a schematic view illustrating a construction of a conventional CMP equipment. With reference to FIG. 1, the conventional CMP equipment may include a platen 10 on which a polishing pad which makes surface contact with a surface of a wafer so as to make physical friction against the surface of the wafer, is mounted, a polishing head 20 for fixedly holding a wafer and pressing down the wafer placed on the polishing pad 11 so as to make the wafer be in fiction contact with the polishing pad 11, a spindle 30 for rotating the polishing head 20 while pressing the polishing head 20 holding the wafer toward the polishing pad 11, and a loading unit 40 for loading a wafer to be polished on the polishing head 20 or unloading the wafer from the polish head 20 after the polishing, etc.

In such loading unit 40, a wafer is placed on an upper surface of a loading plate 42 installed at an uppermost part of a loading cup 41 so as to be supported by a loading plate, and the wafer placed between the loading plate 42 and the polishing head 20 is held by or separated from them relative to each other, and an arm 44 connected with the loading cup 41 rotates toward the polishing head 20 about a rotational shaft 43 and moves up and down.

Meanwhile, additionally to the structure, the conventional CMP equipment has a disadvantage in that alien substances including slurry particles, etc., which are generated while polishing a wafer, settle in a groove of the polishing pad 11, so that a scratch is generated in the wafer, or the lifetime of the polishing pad 11 is reduced.

Then, the conventional CMP equipment may further include a cleaning device for removing alien substances including slurry particles on the polishing pad 11.

For example, the cleaning device is assembled with a lower surface of a spindle 30 so as to revolve above the polishing pad 11 along with the polishing head 20 by the rotation of the spindle 30. The cleaning device injects cleaning liquid, such as deionized water or ultrapure water, etc., on the polishing pad 11 so as to remove alien substances, including slurry particles on the polishing pad 11.

However, since the conventional cleaning device for the CMP equipment injects only cleaning liquid in a single manner, the rate of removing slurry articles or alien substances is low, so that it is impossible to prevent scratching of a wafer and lifetime-reduction of the polishing pad, as mentioned above.

Furthermore, in the conventional CMP equipment, friction heat caused by friction force is generated in the polishing pad while a polishing process is performed, so that the polishing pad has a high temperature.

DISCLOSURE OF THE INVENTION

Accordingly, the present invention has been made to solve the above-mentioned problems occurring in the prior art, and an object of the present invention provides a cleaning device for a CMP equipment, which sufficiently remove alien substances including slurry particles on a polishing pad.

Also, another object of the present invention provides a cleaning device for a CMP equipment which copes with friction heat generated in a polishing pad while a polishing process is performed.

TECHNICAL SOLUTION

In order to accomplish the above-mentioned objects, here is provided a cleaning device for a CMP equipment, including: a irrotatable center shaft irrotatably coupled with a spindle which is rotated, the irrotatable center shaft including a first channel and a second channel formed in an interior of the irrotatable center shaft, cleaning liquid flowing into the first channel and compressed gas flowing into the second channel; and a nozzle block coupled with the spindle so as to revolve about the irrotatable center shaft above a polishing pad, the nozzle block mixing cleaning liquid supplied through the first channel with compressed gas supplied through the second channel so as to generate twin-fluid and pressure-injecting the mixed-generated twin-fluid on the polishing pad.

BRIEF DESCRIPTION OF THE DRAWINGS

The above and other objects, features and advantages of the present invention will be more apparent from the following detailed description taken in conjunction with the accompanying drawings, in which.

MODE FOR CARRYING OUT THE INVENTION

Figure 1:
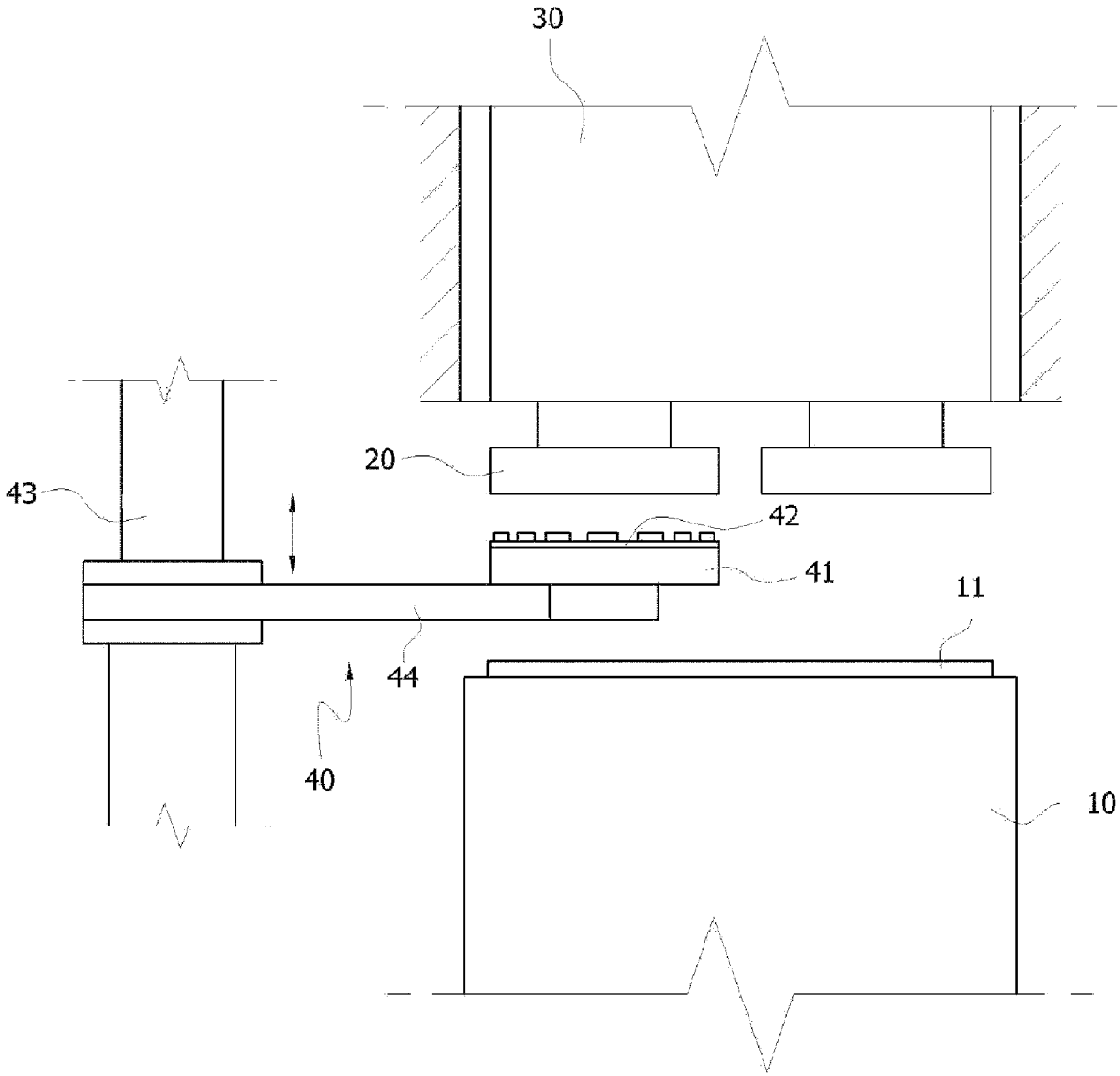
FIG. 1 is a schematic view illustrating construction of a CMP equipment according to the conventional art.

Hereinafter, one exemplary embodiment according to the present invention will be described with reference to the accompanying drawings. Furthermore, it will be understood by those skilled in the art that various changes in form and detail may be made within the scope of the present invention, but the scope of the invention is not to be limited by the above embodiments. It is to be noted that the same elements are indicated with the same reference numerals throughout the drawings.

Figure 2:
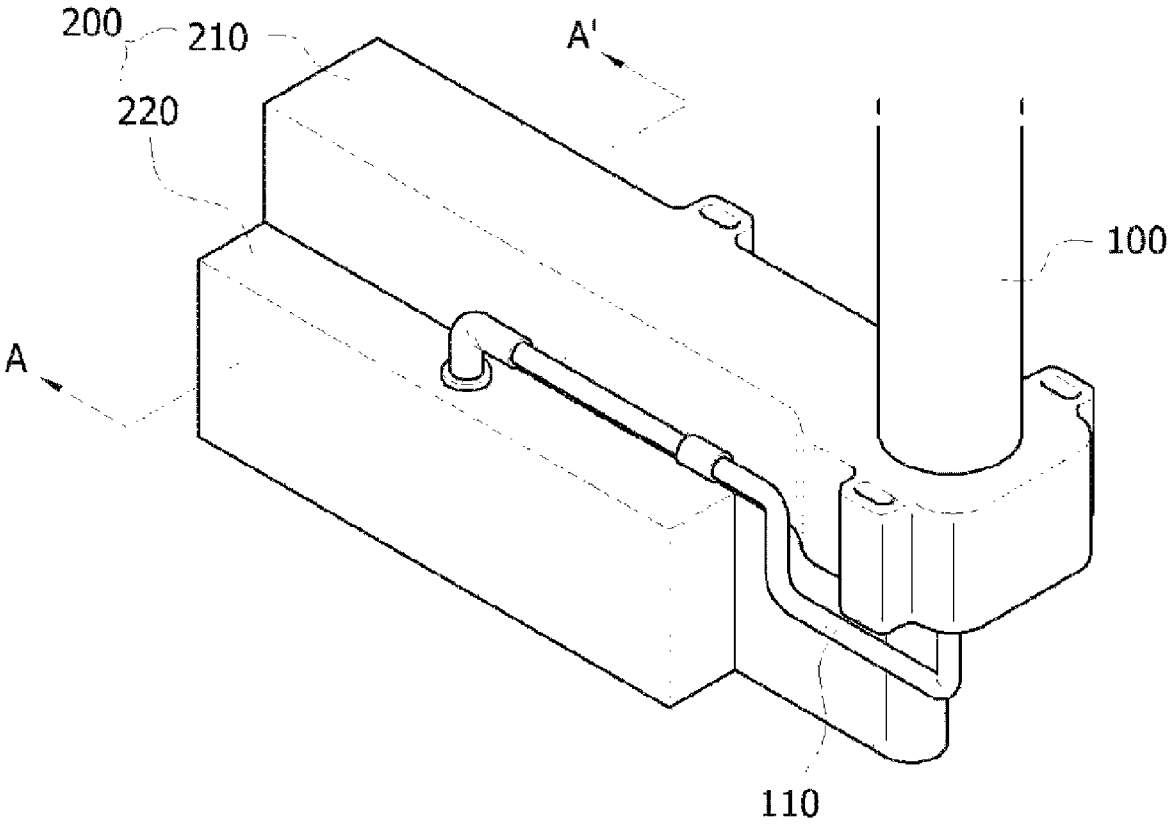
FIG. 2 is a schematic perspective view illustrating a cleaning device for a CMP equipment according to an embodiment of the present invention.
Figure 3:
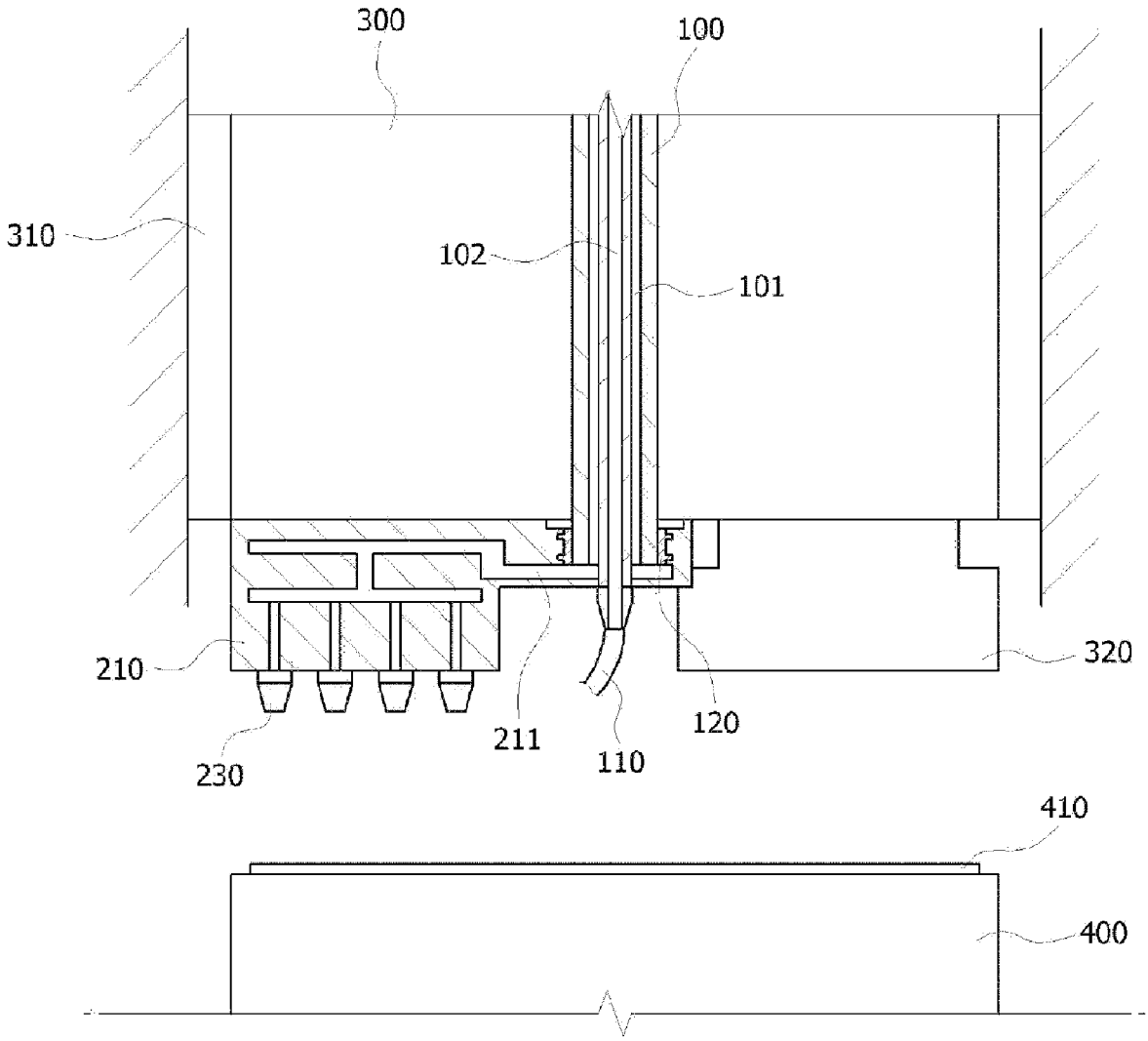
FIG. 3 is a schematic sectional view of a CMP equipment employing a cleaning device for a CMP equipment according to an embodiment of the present invention.
Figure 4:
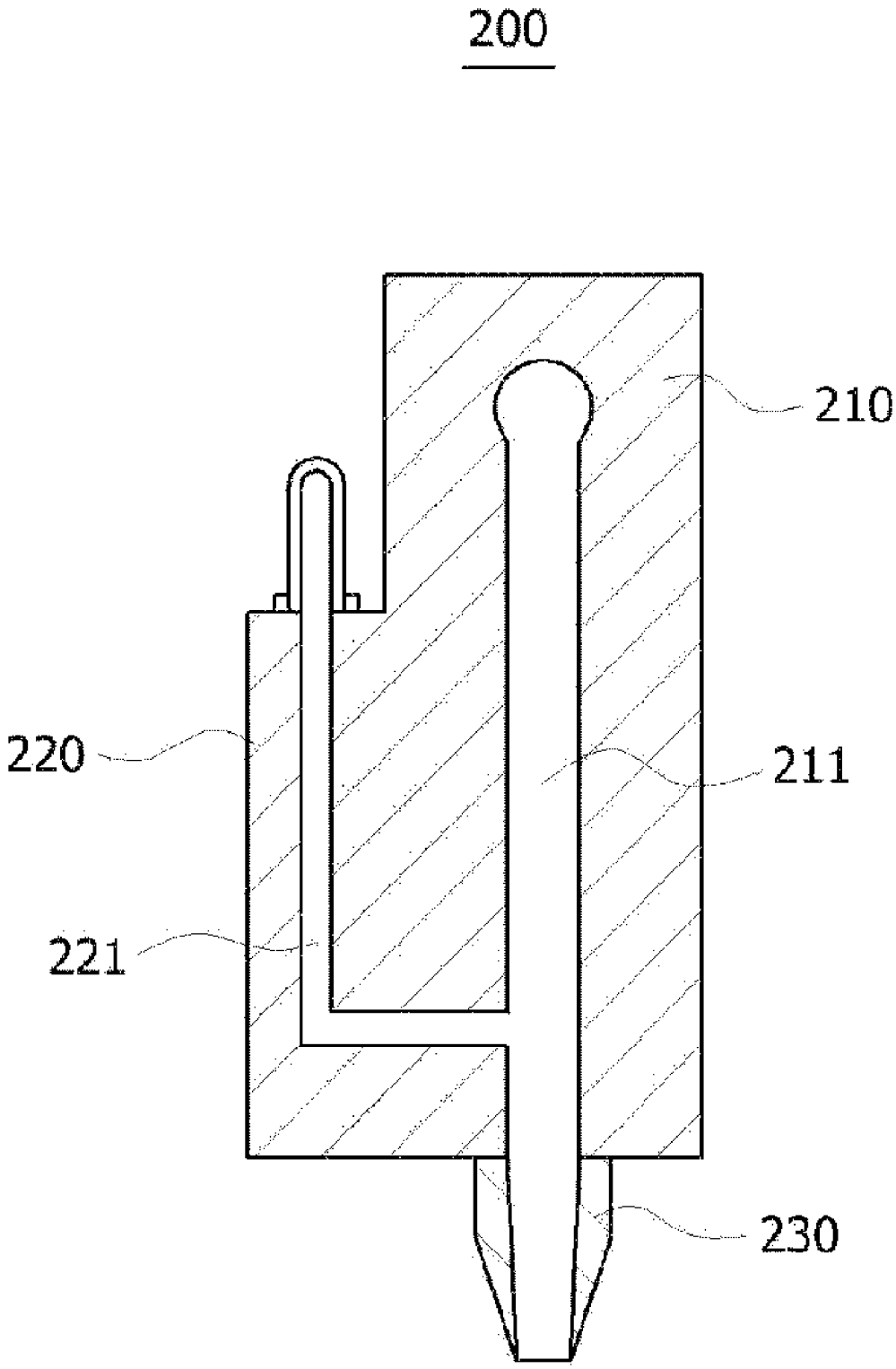
FIG. 4 is a schematic sectional view of a cleaning device for a CMP equipment, which is taken along line A-A' of FIG. 2.

FIG. 2 is a schematic perspective view illustrating a cleaning device for a CMP equipment according to an embodiment of the present invention, FIG. 3 is a schematic sectional view of a CMP equipment employing a cleaning device for a CMP equipment according to an embodiment of the present invention; and FIG. 4 is a schematic sectional view of a cleaning device for a CMP equipment, which is taken along line A-A' of FIG. 2.

With reference to FIGS. 2 to 4, a cleaning device for a CMP equipment according to an exemplary embodiment of the present invention includes an irrotatable center shaft 100 having a first channel 101 which is irrotatably coupled with a spindle 300 and into which cleaning liquid flows, and a second channel 102 into which compressed gas follows, and also includes a nozzle block 200 which is coupled with the spindle 300 so as to revolve about the irrotatable center shaft 100 above a polishing pad 410 installed at a platen 400, mixes cleaning liquid supplied through the first channel 101 with compressed gas supplied through the second channel 102 so as to generate twin-fluid, and pressure-injects the generated twin-fluid on the polishing pad 410.

The irrotatable center shaft 100 extends through the central part of the spindle 300 so as to be coupled with the spindle 300. The irrotatable center shaft 100 is an irrotatable shaft unrelated to the rotation of the spindle 300.

For example, the irrotatable center shaft 100 has a rotary fitting (not shown) installed at a portion thereof which is coupled with the spindle 300, so that the irrotatable center shaft 100 does not rotate even though the spindle 300 rotates in order to perform a polishing process.

For example, the spindle 300 is provided with rotational force from a separated driving source (not shown) so as to rotate, and has a spindle housing 310, which does not rotate, installed at an outer circumference thereof. A bearing (not shown) may be installed at such a portion where the spindle 300 and the spindle housing 310 are coupled with each other.

Furthermore, the spindle 300 may have a polishing head 320 coupled therewith, which fixedly holds a wafer, rotates the wafer while pressing the wafer, and make the wafer be in friction contact with the polishing pad 410, coupled with a side of the lower surface thereof, and may have a conditioning head (not shown) coupled therewith, which reforms a surface of the polishing pad 410 installed at the opposite side.

The irrotatable center shaft 100 is installed at a lower surface of the spindle 300 and has two channels formed at interior thereof so as to supply cleaning liquid and compressed air to a nozzle block 200 which is rotated along with the spindle. One channel is the first channel 101 supplied with cleaning liquid, such as deionized water or ultrapure water, etc., from a cleaning liquid supplying source (not shown), and the other one is the second channel 102 which is formed along an axis line of the first channel 101 in the interior thereof so as to be supplied with compressed air from a compressed air supplying source (not shown).

Particularly, the irrotatable center shaft 100 has a dual-piping structure in the interior thereof, which allows two kinds of fluids to flow through channels separate from each other, respectively.

The irrotatable center shaft 100 has a lower end which is inserted into one end of the nozzle block 200 so as to be coupled with each other, and a rotary fitting 120 is preferably installed at the portion where the irrotatable center shaft 100 is coupled with the nozzle block 200.

As such, the rotary fitting 120 is installed at the portion where the irrotatable center shaft 100 is coupled with the nozzle block 200, and is a typical component for piping connection, which can make a sealing between the non-rotating irrotatable center shaft 100 and the rotating nozzle block 200 and also can achieve a stable supply of fluid from the irrotatable center shaft 100 to the nozzle block 200, which is coupled with and rotates together with the spindle 300 even though the irrotatable center shaft 100 does not rotate.

Such nozzle block 200 is coupled with a lower surface of the spindle 300 and mixes cleaning liquid and compressed gas which are supplied from the irrotatable center shaft 100 so as to generate twin-fluid. The nozzle block 200 pressure-injects the generated twin-fluid on the polishing pad 410 so as to remove alien substances including slurry particles, etc., on the polishing pad. As such, the nozzle block 200 is a component for cleaning the polishing pad 410.

Particularly, the nozzle block 200 includes the first block 210, which is supplied with cleaning liquid through the first channel 101 and injects it on the polishing pad 410, and the second block 220, which is supplied with compressed gas through the second channel 102 and supplies it to the first block 210.

The first block 210 has a cleaning liquid channel 211 coupled with a lower end of the irrotatable center shaft 100 so as to be supplied with cleaning liquid through the first channel 101 and inject the cleaning liquid on the polishing pad 410.

The second block 200 has a flexible gas connection line 110 communicated with the second channel 102 at the lower end of the irrotatable center shaft 100 so as to enable compressed gas supplied through the second channel to flow into a gas channel 221.

Furthermore, the gas channel 221 of the second block 220 supplies the compressed gas flowing through the gas connection line 110 to the cleaning liquid channel 211 of the first block 210 so that cleaning liquid is rapidly injected from the first block 210.

Particularly, the conventional cleaning device for the CMP equipment injects only cleaning liquid in a singular manner, so that injection force is weak. Therefore, the rate of removing slurry particles or alien substances, etc., which are generated in a groove of the polishing pad 410, is low. Meanwhile, in the cleaning device for the CMP equipment according to an embodiment of the present invention, cleaning liquid is pressurized by compressed gas so as to be rapidly injected, thereby securing a high rate of removing alien substances, including slurry particles on the polishing pad 410.

Particularly, although moist and clean air may be used as compressed gas used in order to pressurize cleaning liquid and rapidly inject it, nitrogen (N2) gas may be preferably used as the compressed gas in order to cool the polishing pad 410 during the polishing process.

Particularly, the present embodiment describes the case of cleaning liquid being rapidly injected by using nitrogen (N2) gas as compressed gas as well as the case of the polishing pad 410 being cooled by using nitrogen (N2) gas as compressed gas.

As such, even through nitrogen gas is illustrated as compressed gas in the present embodiment, it would be easily understood that if a fluid can pressurize cleansing liquid so as to rapidly inject it and can cool the polishing pad 410 while not influencing the polishing process, the fluid can substitute for the illustrated nitrogen gas.

Particularly, when a wafer polishing process for fixedly hold a wafer by the polishing head 320, rotating the wafer while pressing it, and making the wafer be in friction contact with the polishing pad 410 is performed, supplying of cleaning liquid to the first channel 101 is cut off, and only nitrogen gas is supplied through the second channel 102 so that the first block 210 injects only nitrogen gas on the polishing pad 410, thereby cooling friction heat generated in the polishing pad.

As such, after the wafer polishing process is performed, when alien substances including a predetermined amount of slurry particles are generated on the polishing pad 410, the nozzle block 200 is as mentioned above supplied with cleaning liquid as well as compressed gas so as to rapidly inject cleaning liquid on the polishing pad 410, thereby removing alien substances including slurry particles and cleaning the polishing pad 410.

In above-mentioned structure, the first block 210 preferably includes a plurality of injection openings 230 having injection areas overlapped with each other from the center of the polishing pad 410 toward a radius direction thereof, respectively.

Therefore, the first block 210 rapidly injects cleaning liquid on the whole area of the polishing pad 410 in a radius direction while rotating along with the spindle 300, thereby cleaning the whole area of the polishing pad 410, at which the polishing process is performed.

Furthermore, the second block 220 preferably supplies compressed gas toward respective injection openings 230 so as to enable cleaning liquid to be rapidly injected from respective openings 230 of the first block 210.

Although an exemplary embodiment of the present invention has been described for illustrative purposes, those skilled in the art will appreciate that various modifications, additions and substitutions are possible, without departing from the scope and spirit of the invention as disclosed in the accompanying claims.

INDUSTRIAL APPLICABILITY

As mentioned above, the present invention pressurizes cleaning liquid so as to rapidly inject it toward a polishing pad so that slurry particles and alien substances on the polishing pad can completely be removed. Furthermore, wafer scratch is prevented and the lifetime of the polishing pad also increases.

Also, the present invention stably supplies cleaning liquid and compressed gas from an irrotatable center shaft to a nozzle block even when the nozzle block rotates along with a spindle.

Furthermore, the present invention cuts off supplying of cleaning liquid during a wafer polishing process, and injects only compressed gas on the polishing pad, thereby cooling the polishing pad.

What is claimed is:

1. A cleaning device for a chemical-mechanical polishing equipment, comprising:

a irrotatable center shaft irrotatably coupled with a spindle which is rotated, the irrotatable center shaft including a first channel and a second channel which are formed in an interior of the irrotatable center shaft, cleaning liquid flowing into the first channel and compressed gas flowing into the second channel; and a nozzle block coupled with the spindle so as to revolve about the irrotatable center shaft above a polishing pad, the nozzle block mixing cleaning liquid supplied through the first channel with compressed gas supplied through the second channel so as to generate twin-fluid and pressure-injecting the mixed twin-fluid on the polishing pad.

2. The cleaning device for a chemical-mechanical polishing equipment as claimed in claim 1, wherein the nozzle block comprises a first block, which is supplied with cleaning liquid through the first channel and injects the cleaning liquid on the polishing pad, and a second block which is supplied compressed gas through the second channel and supplies the compressed gas to the first block so as to rapidly inject the cleaning liquid from the first block on the polish pad.

3. The cleaning device for a chemical-mechanical polishing equipment as claimed in claim 2, wherein the first block has a plurality of injection openings having injection areas overlapped with each other from a center of the polishing pad toward a radius direction of the polishing pad.

4. The cleaning device for a chemical-mechanical polishing equipment as claimed in claim 3, wherein the second block can supply compressed gas to respective injection openings of the first block.

5. The cleaning device for a chemical-mechanical polishing equipment as claimed in claim 4, wherein compressed gas supplied to the second channel comprises nitrogen gas.

6. The cleaning device for a chemical-mechanical polishing equipment as claimed in claim 5, wherein the first block injects only nitrogen gas supplied through the second channel when supply of cleaning liquid supplied through the first channel is cut off.

7. The cleaning device for a chemical-mechanical polishing equipment as claimed in claim 3, wherein compressed gas supplied to the second channel comprises nitrogen gas.

8. The cleaning device for a chemical-mechanical polishing equipment as claimed in claim 7, wherein the first block injects only nitrogen gas supplied through the second channel when supply of cleaning liquid supplied through the first channel is cut off.

9. The cleaning device for a chemical-mechanical polishing equipment as claimed in claim 2, wherein compressed gas supplied to the second channel comprises nitrogen gas.

10. The cleaning device for a chemical-mechanical polishing equipment as claimed in claim 9, wherein the first block injects only nitrogen gas supplied through the second channel when supply of cleaning liquid supplied through the first channel is cut off.

11. The cleaning device for a chemical-mechanical polishing equipment as claimed in claim 1, wherein a rotary fitting is installed at a portion where the nozzle block and the irrotatable center shaft are coupled with each other.

12. The cleaning device for a chemical-mechanical polishing equipment as claimed in claim 11, wherein compressed gas supplied to the second channel comprises nitrogen gas.

13. The cleaning device for a chemical-mechanical polishing equipment as claimed in claim 12, wherein the first block injects only nitrogen gas supplied through the second channel when supply of cleaning liquid supplied through the first channel is cut off.

14. The cleaning device for a chemical-mechanical polishing equipment as claimed in claim 1, wherein compressed gas supplied to the second channel comprises nitrogen gas.

15. The cleaning device for a chemical-mechanical polishing equipment as claimed in claim 14, wherein the first block injects only nitrogen gas supplied through the second channel when supply of cleaning liquid supplied through the first channel is cut off.

* * * * *